United States Patent [19]

Ongaro

[11] 4,221,155

[45] Sep. 9, 1980

[54] VIBRATION-FREE HYDRAULIC POWER SYSTEM

[75] Inventor: Theodore Ongaro, Columbus, Ohio

[73] Assignee: Ongaro Dynamics, Ltd., Columbus, Ohio

[21] Appl. No.: 909,268

[22] Filed: May 24, 1978

[51] Int. Cl.[3] ..... F01B 7/02; F01B 9/00

[52] U.S. Cl. ..... 91/186; 91/461; 92/69 R; 92/136

[58] Field of Search ..... 92/69 R, 69 A, 69 B, 92/75, 50, 136; 91/171, 186

[56] References Cited

U.S. PATENT DOCUMENTS

| | | | |
|---|---|---|---|
| 615,810 | 12/1898 | Crockford | 92/69 R |
| 2,811,148 | 10/1957 | Bobrowsky | 92/69 R |
| 2,876,751 | 3/1959 | Kolthoff, Jr. | 92/69 R |
| 3,693,501 | 9/1972 | Ward | 91/186 |
| 3,971,296 | 7/1976 | Tugwell | 92/69 R |

FOREIGN PATENT DOCUMENTS

| | | | |
|---|---|---|---|
| 583377 | 10/1924 | France | 92/69 B |

*Primary Examiner*—Paul E. Maslousky
*Attorney, Agent, or Firm*—Frost & Jacobs

[57] ABSTRACT

A vibration-free hydraulic power system having an opposing pair of pistons adapted to be moved in unison with the same stroke and equal force, but in opposite directions, one of the pistons being operatively connected to an external mass to be moved, the other of the pistons being operatively connected to a reactive mass the weight of which is identical to the weight of the mass being moved, the reactive mass acting to maintain the system in an equilibrium state during its complete operating cycle, the system incorporating a pair of control valves each having a series of sequentially acting valve elements which control fluid flow to and from the system, the pistons and control valves working at all times against solid columns of fluid under positive but variable pressure.

14 Claims, 5 Drawing Figures

VIBRATION-FREE HYDRAULIC POWER SYSTEM

This invention relates to hydraulic power systems and has to do more particularly with systems operable in the cyclic order at the rate of over two one thousands of a second (2/1000sec.) associated with large mass movements involving acceleration at the rate of several hundred or more G's, a G being the unit of force applied to a body at rest equal to the force exerted on it by gravity, the standard or accepted value being 980.665 cm/sec.$^2$.

An hydraulic power system capable of operating within the foregoing parameters is disclosed in co-pending U.S. application Ser. No. 720,562, filed Sept. 7, 1976, now U.S. Pat. No. 4,096,784, and entitled "Hydraulic Power System". The power system disclosed in the said application comprises a dual acting work piston adapted to be operatively connected to an external mass to be moved, the piston being instantly directionally responsive to a pair of control valve adapted to be sequentially opened and closed to actuate the work piston for movement in opposite directions. The control valves each has a series of sequentially acting valve elements which control fluid flow to and from the work piston, the system forming an hydraulic closed loop which is completely filled with fluid during both charging and discharging, the work piston and control valves working at all times against solid columns of fluid under controlled positive pressures. While such system has proven to be highly effective, the high accelerating velocities at which the system operates generate severe vibratory shocks the magnitude of which is increased depending upon the magnitude of the mass being moved by the piston. While in some applications these shocks can be tolerated, in others they pose an acute problem.

By way of example, where the hydraulic power system is utilized to actuate a honing device adapted to be rapidly moved into and out of contact with the periphery of a tire rotating at high speed to remove centrifugally generated imperfections in the tread, severe vibratory shocks are created as the work piston moves the honing device from one position to the other. These vibratory shocks, unless damped by massive support structure, adversely affect the electronic sensing devices utilized to detect and locate the imperfections in the tire being corrected.

It has now been found that these undesirable vibratory shocks can be effectively eliminated by modifying the construction of the hydraulic power system to include reactive means which maintain the kinetic forces generated by the system in an equilibrium state at all times, thereby providing a system which is free from vibration during its complete operating cycle.

SUMMARY OF THE INVENTION

In accordance with the present invention, the power system comprising a housing containing an opposing pair of work pistons disposed in a common piston chamber having appropriate manifolding, the two pistons being controlled to move in unison with the same stroke and equal force, but in opposite directions.

The pistons have opposite directed piston rods projecting outwardly from opposite sides of the housing, one of the piston rods being connected to the mass to be moved, such as the aforementioned honing device, whereas the other piston rod is connected to a reaction mass (weight) identical to that of the mass being moved.

To insure equal but opposite movement of the two pistons at the same rate of acceleration, the two pistons are mechanically interconnected utilizing rack and pinion means which cause the pistons to move in unison in both directions.

Movement of the pistons is controlled by a pair of control valves of the type disclosed in the aforementioned co-pending application Ser. No. 720,562, the control valves being of identical construction and having a series of sequentially acting valve elements which control fluid flow to and from the pistons. The control valves are so arranged that they have high and low pressure sides, the high pressure sides alternately supplying fluid under high pressure to opposite sides of the pistons to displace them in one direction and then in the other. The low pressure sides of the control valves serve to control the discharge of fluid from the opposite sides of the pistons, preset check valves being provided so that the entire system remains fully charged with fluid at all times, the pistons and control valves always working against solid columns of fluid under controlled positive pressures. For example, a positive but nominal fluid pressure, such as 5–10% of the main working pressure, is maintained in the system at all times with charges of fluid under high pressure alternately introduced into the opposite sides of the system to alternately displace the pistons in opposite directions. The high pressure charge introduced into one side of the system upon opening movement of one of the control valves is maintained in the system until relieved upon commencement of the opening movement of the other of the control valves, the arrangement being such that the high pressure fluid on one side of the system will be relieved prior to the introduction of high pressure fluid on the other side of the system. In effect, the system forms a dual hydraulic closed loop which is pressurized at all times, even when in an idle state. Since the system is completely filled with fluid at all times, and since the fluid is essentially incompressible, each of the pistons will be fixedly maintained at either end of its stroke by the full force of the high pressure fluid which drove the piston from one end of its stroke to the other.

Accordingly, a principal object of the present invention is the provision of an improved hydraulic power system which is effectively free from vibration when utilized to move an external mass.

A further object of the invention is the provision of an hydraulic power system particularly suited for use in conjunction with tire correction apparatus such as that taught in U.S. Pat. No. 4,084,350 wherein honing devices are actuated to remove rubber from the periphery of a tire rotating at high speed, the honing devices being actuated by sensors which indicate the magnitude and location of the areas of the tire which require honing. It is to be understood, however, that the utility of the invention is not so limited and it may be utilized in any application wherein an external mass must be rapidly moved in an essentially vibration-free manner.

The foregoing as well as other objects of the invention which will appear hereinafter or which will be evident to the worker in the art upon reading this specification are accomplished by that construction and arrangement of parts of which exemplary embodiments shall now be described.

DESCRIPTION OF THE PREFERRED EMBODIMENTS

Figure 1:
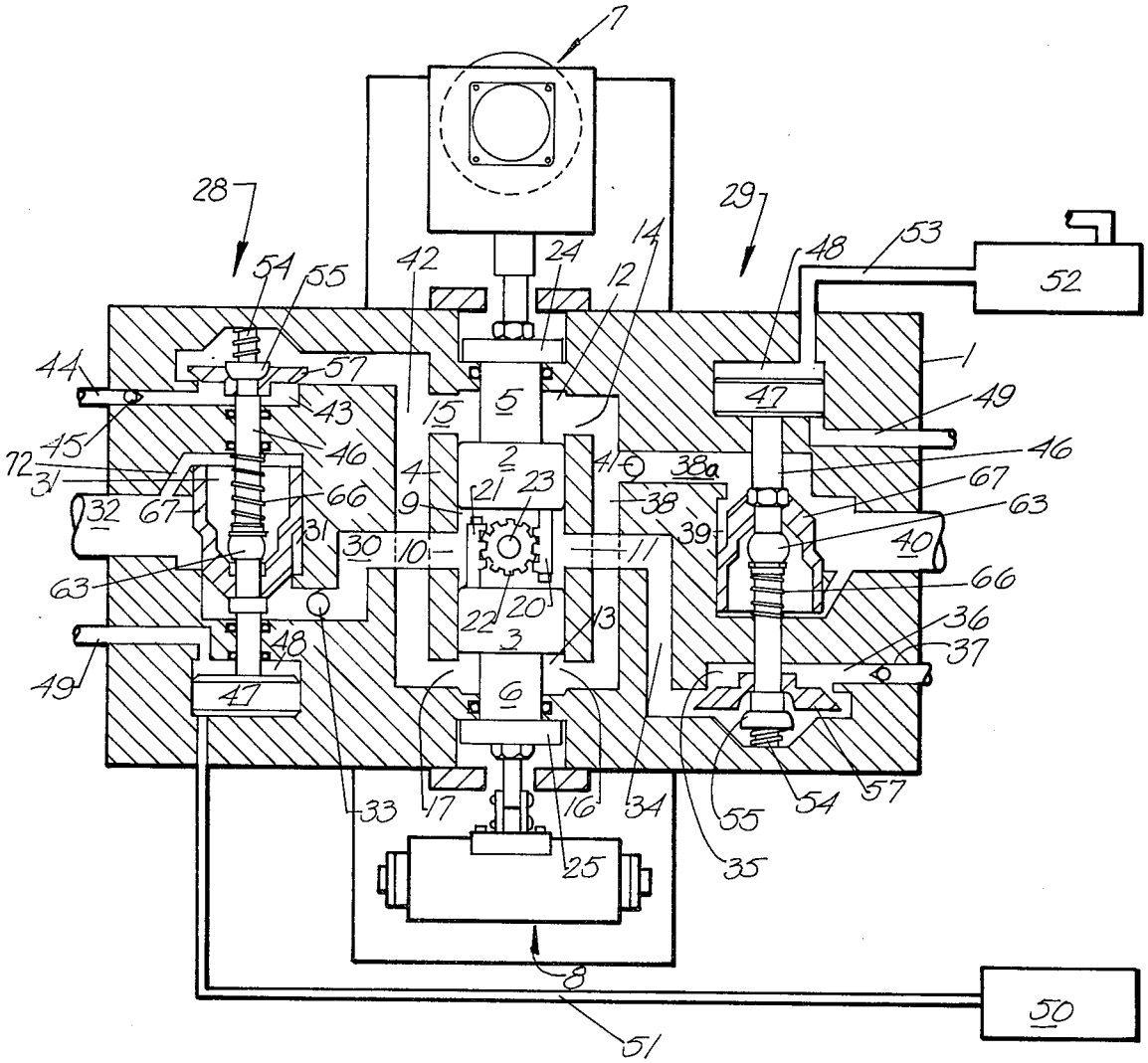
FIG. 1 is a sectional view of an hydraulic control system in accordance with the invention in which the opposing pistons are in their retracted position, one of the control valves being in the fully closed position and the other in the fully opened position.

Referring first to FIG. 1, a housing 1 is provided with a pair of centrally disposed opposing pistons 2 and 3 mounted within a common piston chamber 4, the pistons 2 and 3 having oppositely directed piston rods 5 and 6, respectively, projecting outwardly from the housing, the piston 2 through its piston rod 5 being operatively connected to a mass to be moved, indicated at 7, which in the illustrated embodiment comprises a honing device.

Opposing piston 3 through its piston rod 6 is connected to a reaction mass 8 the weight of which will be identical to the weight of the mass 7. The pistons and piston rods are movable from the innermost or retracted position illustrated in FIG. 1 to the outermost or extended position illustrated in FIG. 2.

Figure 2:
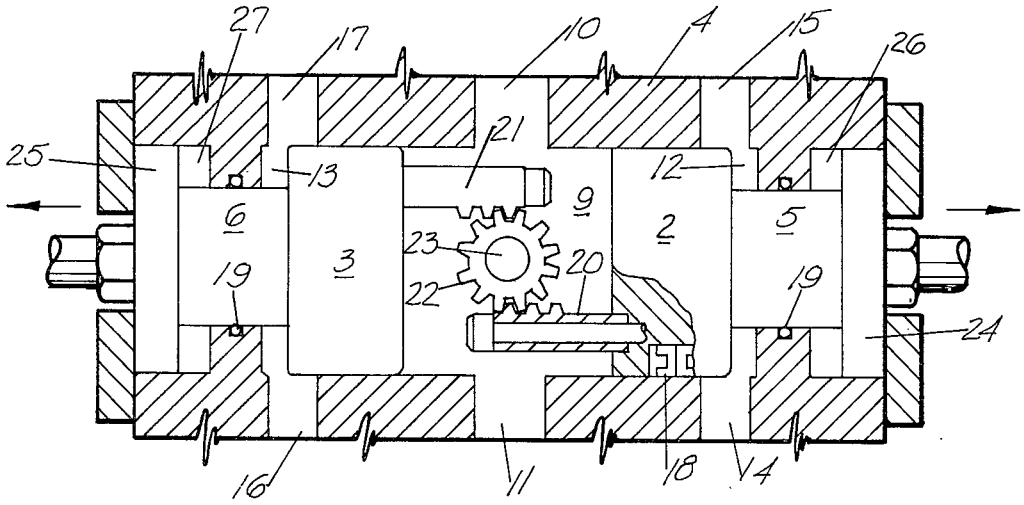
FIG. 2 is an enlarged sectional view showing the pistons in their extended position.

As best seen in FIG. 2, the cylindrical bore 4 defines a centrally disposed piston chamber 9 lying between the pistons 2 and 3, the chamber 9 having a delivery port 10 through which fluid under high pressures is introduced to displace the pistons outwardly relative to each other, the chamber 9 also being provided with a discharge port 11 for discharging high pressure fluid from the chamber 9. On their opposite or outermost sides, the pistons 2 and 3 are received in chamber 12 and 13, respectively, the chamber 12 having an inlet port 14 and a discharge port 15. In like manner, the chamber 13 has an inlet port 16 and a discharge port 17. It will be understood that suitable gaskets, seals and the like will be provided to effectively seal the chambers relative to the pistons and piston rods. Thus, the pistons 2 and 3 may be provided with suitable piston rings 18, as illustrated in FIG. 2; and similarly the piston rods 5 and 6 will be provided with sealing rings or other suitable packing members 19, as will be understood by the worker in the art.

The pistons 2 and 3 are interconnected for simultaneous and equal movement by means of the rack gears 20 and 21, the former being secured to the inner face of piston 2 and the latter to the inner face of piston 3, the rack gears meshing with a centrally disposed pinion 22 rotatably journaled on a spindle 23 extending through and fixedly secured to the opposite sides of chamber 9. With this arrangement, the pistons are mechanically interconnected and equal but opposite displacement is assured. If desired, the piston rods 5 and 6 may be provided with stops 24 and 25, respectively, formed from a cushioning material, the stops moving between the inner and outer ends of chambers 26 and 27 and serving as cushions for the piston—piston rod assemblies at the opposite ends of their strokes.

The flow of fluid to and from the piston chambers is controlled by a pair of control valves indicated generally at 28 and 29 in FIG. 1, the control valves lying on opposite sides of the pistons.

Fluid under high pressure is delivered to centrally disposed piston chamber 9 through delivery passageway 30, connected to port 10, valve chamber 31 and inlet passageway 32, the latter passageway being connected to a source of fluid under high pressure (not shown). A check valve 33 in passageway 30 is oriented to permit fluid to flow inwardly through passageway 30 into chamber 9, but fluid in passageway 30 cannot flow outwardly in the direction of valve chamber 31. The piston chamber 9 also communicates through discharge port 11 with a discharge passageway 34 which is in communication with a valve chamber 35 having an outlet passageway 36. A check valve 37 in outlet passageway 36 is oriented to permit fluid to flow outwardly through passageway 36 but not inwardly. In similar fashion, the piston chambers 12 and 13 are jointly supplied with fluid under high pressure through inlet ports 14 and 16, respectively, which are jointly connected through passageways 38 and 38*a* to valve chamber 39 of control valve 29, the valve chamber 39 having an inlet passageway 40 also connected to a source of fluid under high pressure, which is not shown. Passageway 38*a* is provided with a check valve 41 oriented to permit fluid to flow into valve chambers 12 and 13, respectively, but fluid in the valve chambers cannot flow back into passageway 38 in the direction of control valve 29.

Fluid discharged from piston chambers 12 and 13 flows through discharge ports 15 and 17 into a common passageway 42 in communication through control valve 28 with valve chamber 43, the valve chamber 43 in turn being in communication with an outlet passageway 44 having a check valve 45 oriented to permit fluid from flowing inwardly in the direction of valve chamber 43. It will be understood that outlet passageways 36 and 44 will be connected to conduits which return discharged fluid to the source of fluid supply.

The control valves 28 and 29 are identical and are constructed in accordance with the teachings of the aforesaid co-pending application Ser. No. 720,562, each control valve having an elongated axially movable valve stem 46 adapted to be operatively connected to means which will sequentially actuate the valve stems of the two control valves. As taught in the aforesaid co-pending application, the valve stems may be actuated by mechanically driven cam means, by electrically actuated solenoids, or by means of hydraulic actuating valves. In the embodiment illustrated, the valve stems 46 are provided with pistons 47 slidably received in piston chambers 48 formed in housing 1, the chambers having vents 49 on the inner sides of the pistons 47. An hydraulic actuating valve 50 controls the movement of control valve 28 through conduit 51, and movement of control valve 29 is controlled by hydraulic actuating valve 52 connected through conduit 53 to the piston chamber 48 of control valve 29. Since the particular manner in which the control valves are actuated does not constitute a part of the present invention, reference is made to the aforesaid co-pending application for details of the construction and operation of the actuating valves 50 and 52, the essential factor insofar as the present invention is concerned being the provision of means which will sequentially open and close the control valves 28 and 29 in timed relation.

Figure 3:
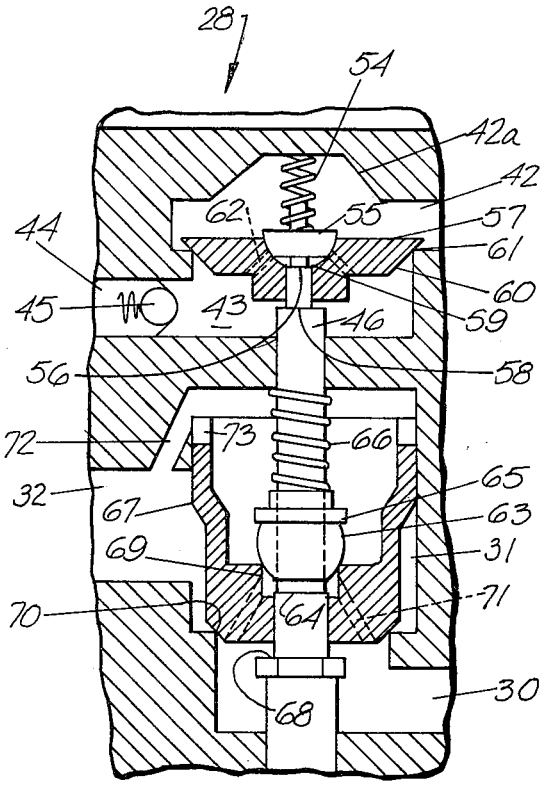
FIG. 3 is an enlarged sectional view of one of the control valves in the fully closed position.
Figure 4:
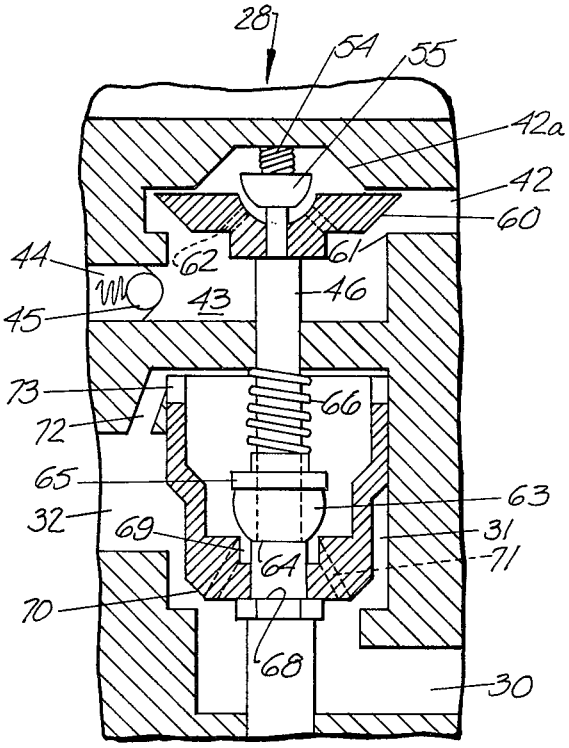
FIG. 4 is a sectional view similar to FIG. 3 illustrating the control valve in the fully opened position.

While the control valves are also disclosed and described in detail in the aforesaid co-pending application, an understanding of their construction and operation is essential to an understanding of the operation of the present invention and consequently they will now be described in detail. Reference is made to FIGS. 3 and 4 of the drawings which are enlarged views of control valve 28 in the fully closed and fully opened positions, respectively, it being understood that control valves 28 and 29 are of identical construction. A spring 54 surrounds the distal end of valve stem 46 and extends between a recess 42*a* in passageway 42 and a first valve element 55 slidably mounted on the portion of valve stem 46 lying outwardly beyond a first shoulder 56 formed on the valve stem, the shoulder having a greater diameter than the portion of the valve stem on which the first valve element 55 is slidably mounted. A second valve element 57 is slidably mounted on the portion of the valve stem lying between the first shoulder 56 and a second shoulder 58 which is of a larger diameter than the shoulder 56. The second valve element 57 has a centrally disposed recess 59 which serves as a seat for first valve element 55, and the second valve element 57 also has an annular surface 60 adapted to seat against the peripheral edge 61 of outlet valve chamber 43, the second valve element, when in the closed position, forming a seal between discharge passageway 42 and outlet valve chamber 43. The second valve element 57 is provided with a series of bleeder passages 62 extending between the centrally disposed recess 59 and the undersurface of the valve element 57 where the passages communicate with outlet chamber 43. When the first valve element 55 is seated in recess 59, the bleeder passages 62 are closed to the flow of fluid therethrough.

A third valve element 63 is slidably mounted on valve stem 46 within the confines of inlet valve chamber 31, the valve stem having a third enlarged shoulder 64 lying on the opposite or under side valve of the third valve element 63. The third valve element 63 is biased in the direction of third shoulder 64 by means of a collar 65 and spring 66 surrounding the valve stem 46, the spring extending between the collar 65 and the closed upper end of inlet valve chamber 31. A fourth valve element 67, which is cup-shaped, is also contained within inlet valve chamber 31, the fourth valve element being slidably mounted on the portion of the valve stem 46 lying between third shoulder 64 and a fourth enlarged shoulder 68. The cup-shaped fourth valve element 67 has a centrally disposed recess 69 which forms a seat for the third valve element 63 when the latter is in the closed position, and the fourth valve element also has an annular surface 70 adapted to seat against and close the peripheral edge of inlet valve chamber 31 at its juncture with delivery passageway 30. Thus, when in the closed position shown in FIG. 3, the fourth valve element 67 prevents the flow of fluid from inlet chamber 31 into delivery passageway 30. The fourth valve element is also provided with a series of bleeder passages 71 extending between the centrally disposed recess 69 and the undersurface of valve element 67 which is in communication with delivery passageway 30. As will be apparent from FIG. 3, when the third valve element 63 is in its closed position, the bleeder passages 71 are closed to the flow of fluid between inlet valve chamber 31 and delivery passageway 30.

The arrangement of the valve elements is such that they will be sequentially opened as the valve stem 46 is displaced. Such sequential opening is controlled by the spacing of the shoulders 56, 58, 64, and 68 relative to the valve elements they are adapted to contact and displace. In an exemplary embodiment, the first shoulder 56 will contact and commence opening movement of the first valve element 55 when the valve stem 46 has traveled approximately ten percent of its intended displacement between its fully closed and fully opened positions. In similar fashion, the second shoulder 58 will contact and commence opening movement of the second valve element 57 when the valve stem has traveled approximately twenty percent of its total displacement, with the third shoulder 64 contacting and commencing opening movement of the third valve element 63 at approximately thirty percent of valve stem displacement, and with the fourth shoulder 68 contacting and commencing opening movement of the fourth valve element 67 at approximately forty percent of total valve stem displacement. While the valve elements open and close quite rapidly, their sequential movement is important to the operation of the system in order to maintain the system under positive fluid pressure at all times, the control valve elements coacting with the check valves in the delivery and outlet passageways in a manner which will now be described.

Assuming, as a place of beginning, that the control valves are in the positions illustrated in FIG. 1, in which the control valve 28 is in its fully closed position and control valve 29 is in its fully opened position. Under these conditions, the inlet passageway 40 has charged the piston chambers 12 and 13 with fluid under high pressure through valve chamber 39, delivery passageways 38 and 38*a* and inlet ports 14 and 16. In addition, the common discharge passageway 42 is filled with fluid under high pressure through discharge ports 15 and 17. The pistons 2 and 3, by reason of the high pressure fluid in chambers 12 and 13, have been displaced inwardly and lie in their innermost positions. When the control valve 29 is then closed, which will occur immediately after it has reached its fully open position and prior to the opening of control valve 28, the delivery passageway 38*a* will be sealed by valve elements 63 and 67 and high pressure fluid will be trapped in delivery passageways 38 and 38*a*, valve chambers 12 and 13, and discharge passageway 42, it being noted that discharge passageway 42 will remain sealed by valve elements 55 and 57 as long as control valve 28 remains closed. In order to move the pistons 2 and 3 outwardly, it is necessary to open control valve 28 so that high pressure fluid may be introduced into the opposite side of the system through inlet passageway 32. However, in order for the high pressure fluid to displace pistons 2 and 3 outwardly relative to chamber 9, it is necessary to first relieve the high pressure fluid in chambers 12 and 13, the fluid in these chambers effectively holding the pistons 2 and 3 in their innermost positions. High pressure fluid in chambers 12 and 13 is relieved as control valve 28 is opened, the initial movement of valve stem 46 of control valve 28, causing shoulder 56 to contact and lift the first valve element 55, thereby opening bleeder passages 62 to instantly relieve the high pressure fluid in discharge passageway 42. Since the area of valve element 55 is infinitely small in relation to the area of second valve element 57, the force required to open the first valve element 55 against the high pressure fluid in passageway 42 is infinitely small as compared to the force which would be required to open the second valve element 57. As the high pressure fluid flows through bleeder passages 62, the fluid pressure in passageway 42 is instantly relieved and the fluid pressure on the opposite sides of the larger second valve element 57 will be equalized to the lower preset pressure established in chamber 43 by the check valve 45 and the second valve element will be free to open as the second shoulder 58 of valve stem 46 contacts and lifts second valve element 57, thereby breaking the seal between the annular surface 60 of the second valve element and the seat forming peripheral edge 61 of valve chamber 43. The opening of the larger second valve element permits the rapid drop of the high pressure fluid trapped in passageway 42 and piston chambers 12 and 13.

As the trapped high pressure is released, the fluid in chamber 43 will drop to the pre-set nominal pressure of check valve 45, which vents through outlet passageway 44 for return to the fluid supply tank. It is to be understood that prior to the time the first valve element 55 is opened, the outlet valve chamber 43 is also filled with fluid. To this end, the check valve 45 maintains valve chamber 43 filled with fluid at all times, although as long as valve elements 55 and 57 remain closed, the pressure in valve chamber 43 will be at a much lower pressure (5–10% of the high working pressure) as established by the pre-set holding force of check valve 45. Thus, while the fluid under high pressure ahead of valve elements 55 and 57 is relieved, valve chamber 43, discharge passageway 42, piston chambers 12 and 13, and delivery passageway 38 will remain completely filled with fluid, although under reduced pressure which will be equal to the pre-set holding force of check valve 45. In this connection, it will be noted that the check valve 41 in delivery passageway **38*a* is oriented to vent high pressure fluid in the delivery passageway 38*a* down to the holding force of check valve 41, which may be the same pre-set holding force as check valve 45, although it may be somewhat higher, but fluid cannot return into delivery passageway 38*a*. Thus, at the end of the second stage of operation of control valve 28, the fluid pressure holding pistons 2 and 3 in their outermost positions will have been reduced to the pre-set nominal level which is equal to the reduced fluid pressure which is then bearing against the inner faces of the pistons 2 and 3** so that the pistons are momentarily in an equilibrium condition.

As also will be evident from FIG. 1, even when the third and fourth valve elements 63 and 67 of control valve 28 are in their closed positions, high pressure fluid from inlet passageway 32 is free to flow into inlet valve chamber 31 through a branch passageway 72, and consequently high pressure fluid impinges on the inner surfaces of cup-shaped fourth valve element 67 and also on third valve element 63. In the third operating stage of valve 28, continued movement of the valve stem 46 will cause third shoulder 64 to contact third valve element 63 and displace it from sealing contact with recess 69 in the fourth valve element 67, thus opening the bleeder passages 71 in the fourth valve element to the flow of high pressure fluid from valve chamber 31, thereby instantaneously equalizing the fluid pressure on the opposite sides of fourth valve element 67 so that the larger fourth valve element is in an equilibrium state and is free to open as the fourth enlarged shoulder 68 of the valve stem engages and lifts the fourth valve element in the fourth operating stage of valve 28.

Opening of the fourth valve element 67 subjects delivery passageway 30 to the full force of the high pressure fluid, and the high pressure fluid impinges against and opens check valve 33 to permit the fluid to flow through passageway 30 and into the centrally disposed piston chamber 9 through port 10. With this arrangement the high pressure fluid is made instantaneously available to displace the piston heads 2 and 3 outwardly. In this connection, it will be remembered that control valve 29 will have been fully closed prior to the opening of control valve 28 and both piston chamber 9 and discharge passageway 34 will be filled with fluid at nominal pressure, the high pressure fluid having been relieved when control valve 29 commenced its opening movement, just as the high pressure fluid in piston chambers 12 and 13 was relieved upon opening of control valve 28. Consequently, the full impact of the high pressure fluid introduced through inlet passageway 30 acts directly upon the inner faces of pistons 2 and 3, and the only fluid resistance to the movement of the pistons is the nominal fluid pressure previously established in the piston chambers 12 and 13 as opening movement of control valve 28 was initiated. There will be no pressure build up in piston chambers 12 and 13 even upon outward displacement of the pistons 2 and 3 since the chambers 12 and 13 are effectively vented through discharge passageway 42 and the open first and second valve elements 55 and 57 of control valve 28; consequently the fluid pressure in piston chambers 12 and 13 will remain at the nominal pressure established by the check valve 45 in outlet passageway 44. Upon movement of the control valve 28 to the fully opened position, the pressure exerted on actuating piston 47 by actuating valve 50 will be immediately released and the valve stem 46 of the control valve 28 will be returned to its closed position under the influence of springs 54 and 66. Thus, as the fourth shoulder 68 on valve stem 46 retracts, the cup-shaped fourth valve element 67 will be released for closing movement. However, even when the fourth valve element 67 is fully open, there is high pressure fluid on the upstream side of this valve element by reason of a recess 73 (seen in FIGS. 3 and 4) which is in communication with the branch passageway 72 when the valve element 67 is fully opened. Thus there is a balancing of high pressure fluid on both sides of cup-shaped valve element 67 and it is free to move axially on valve stem 46 when released by its supporting shoulder 68. However, positive closing force is not applied until the third shoulder 64 releases the third valve element 63 for closing movement under the influence of spring 66, whereupon third valve element 63 will seat in recess 69 of the fourth valve element 67 and the spring 66 will thereupon urge both valve elements to their fully closed positions, the valve elements thus closing and sealing the entrance to inlet passageway 30. In similar fashion, the second shoulder 58 will release the second valve element 57 for axial movement along the valve stem 46, followed by the release of first valve element 55 by its supporting shoulder 56, whereupon the spring 54 will urge first valve element 55 into contact with the recess 59 in the second valve element and, in turn, will urge both the first and second valve elements to their fully closed positions, it being remembered that the fluid pressure on opposite sides of valve elements 55 and 57 was equalized when these valve elements were opened.

When the control valve 28 is fully closed, high pressure fluid will continue to occupy inlet passageway 30, piston chamber 9 and discharge passageway 34, the latter passageway being closed at its discharge end by the valve elements 55 and 57 of control valve 29 which will not yet have commenced its next opening movement. The outlet valve chamber 35 also will be filled with fluid, but the fluid will be at nominal pressure as established by the check valve 37. As the actuating valve 52 initiates the next cycle of operation by opening control valve 29, the high pressure fluid in chamber 9 and discharge passageway 34 will be relieved and the fluid pressure therein reduced to the nominal value established by check valve 37, followed by the introduction of high pressure fluid into piston chambers 12 and 13 through delivery passageway 38 of control valve 29, the high pressure charge displacing the pistons 2 and 3 inwardly to their retracted positions. Since the entire system is completely filled with fluid at all times, there is no draining and filling of the various passageways and chambers as in conventional systems and the operational time lag is insignificant. The only fluid flow is that which is required to displace the pistons, and the magnitude of pressure which can be exerted on the pistons is limited only by the ability of the system to withstand the pressures which are exerted; consequently tremendous moving forces can be developed.

As should now be evident, when the control valve 28 is opened to introduce fluid under high pressure into the piston chamber 9, the pistons 2 and 3 will be forced outwardly, thereby effecting a power stroke, the piston 2 acting to move the working mass 7 to which it is connected through piston rod 5. The piston 3 effects an equaled but opposite power stroke, the pistons moving in unison by reason of their interconnection through rack gears 20, 21 and pinion 22. Piston 3 is connected to the reactive mass 8 which, as previously indicated, will be calibrated so that its weight is identical to the working mass 7. Thus, the piston velocities, hydraulic pressures, and length of stroke are identical for both pistons, and the kinetic forces within the total assembly are always in an equilibrium state. Consequently, the total assembly is completely free from vibrations generated during its complete operating cycle in all principal axes, i.e., its x, y, and z coordinates.

It will be understood that in the embodiment illustrated the pistons are of equal diameter, as are the piston rods, but due to the size of the piston rods relative to the size on the rack gears on the inner faces of the pistons, the forces generated on the inner faces of the pistons will be greater than the forces generated on the piston rod sides, assuming uniform fluid pressure. If desired, the forces can be equalized by designing the piston-piston rod assemblies to provide equal piston areas on both sides of each piston. In the alternative, force equalization can be achieved by utilizing a proportionately higher fluid pressure in the outer piston chambers which initiate the return strokes of the pistons.

Figure 5:
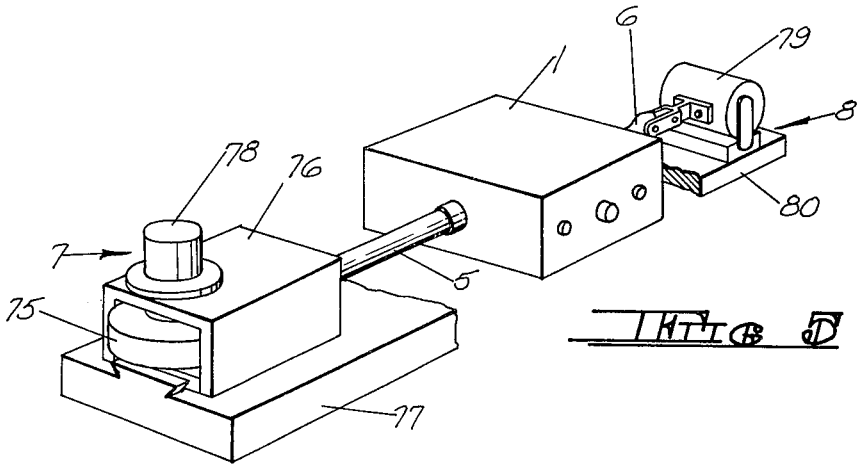
FIG. 5 is a fragmentary perspective view illustrating the use of the system in conjunction with a tire honing device.

FIG. 5 illustrates the use of the hydraulic power system in conjunction with a honing device used to grind the tread of the tire. The mass to be moved, indicated at 7, comprises a honing wheel 75 rotatably mounted in a housing 76 slidably keyed to a support 77, the housing mounting a power source 78, such as a hydraulic motor, for rotating the honing wheel. The honing wheel assembly is movable relative to its support by means of an extension of piston rod 5 projecting from the power system. The piston rod 6 on the opposite side of the system is connected to the reactive mass 8 which comprises one or more weights 79 pivotally mounted on a support 80. The weights 79 precisely match the weight of the honing device so that, as the piston rod 5 moves outwardly to advance the honing device, the piston rod 6 will rock the weights 79 relative to the support 80, the piston rods 5 and 6 moving in unison with the same stroke and equal force. Similarly, when the piston rods are retracted, they will also move in unison with the same stroke and equal force. Since the masses being moved are of identical magnitude and react in opposition to each other, the kinetic forces generated by the system will be in an equilibrium state at all times and the system will be free from vibration during its entire operating cycle.

Modifications may be made in the invention withoug departing from its spirit and purpose. Various modifications have already been set forth, and others will undoubtedly occur to the worker in the art upon reading this specification. Accordingly, it is not intended that the invention be limited other than in the manner set forth in the claims which follow.

The embodiments of the invention in which an exclusive property or privilege is claimed are defined as follows:

1. A fluid power system having a housing reciprocally mounting a work piston having a piston rod projecting outwardly from one side of the housing, said piston rod being adapted to be connected to a mass to be moved, an opposing piston reciprocally mounted in said housing in axial alignment with said work piston, said opposing piston having a piston rod projecting outwardly from the opposite side of said housing adapted to be connected to a reactive mass of a size to counterbalance the mass to be moved, means interconnecting said work piston and said opposing piston for movement in unison in opposite directions, a pair of control valves for selectively supplying fluid under pressure to the opposite sides of said work piston and said opposing piston to move each piston from one end of its stroke to the other, and means for sequentially opening and closing said control valves, one of said control valves, when opened, acting to displace said pistons outwardly in opposite directions, and the other of said control valves, when opened, acting to displace said pistons inwardly in opposite directions.

2. The fluid power system claimed in claim 1 wherein the means interconnecting said work piston and said opposing piston for movement in unison comprises a rack gear connected to each piston, said rack gears engaging a rotatably mounted common pinion.

3. An hydraulic power system comprising a housing, an opposing pair of pistons mounted within said housing, said pistons having a common central piston chamber and separate piston chambers at their opposite ends, said pistons also having oppositely directed piston rods projecting outwardly from the opposite sides of the housing, a mass to be moved connected to one of said piston rods, a reactive mass connected to the other of said piston rods, the weight of the reactive mass being equal to the weight of the mass to be moved, control valve means for sequentially introducing fluid under pressure into said piston chambers to simultaneously displace the pistons in opposite directions, and means contained within said common central piston chamber interconnecting said pistons for movement in unison as they are displaced.

4. The hydraulic power system claimed in claim 3 wherein the means interconnecting said pistons for movement in unison comprises a rack gear connected to each piston, said rack gears engaging a common pinion rotatably mounted in said common piston chamber.

5. The hydraulic power system claimed in claim 3 wherein said control valve means comprises a pair of control valves, means for sequentially opening and closing said control valves, the opening of the first of said control valves acting to displace the pistons outwardly relative to each other, and the opening of the second of said control valves acting to displace the pistons inwardly relative to each other.

6. The hydraulic power system claimed in claim 5 wherein each of said pistons has an outer piston chamber and a common inner piston chamber, fluid delivery passageways and fluid discharge passageways in communication with each of said piston chambers, said control valves each having a high pressure valve member and a pressure relief valve member, the high pressure valve member of the first of said control valves being connected to the fluid delivery passageway of said common inner piston chamber, the pressure relief valve member of the first control valve being connected to the discharge passageways of said outer piston chambers, the high pressure valve member of the second of said control valves being connected to the fluid delivery passageways of said outer valve chambers, and the pressure relief valve member of said second control valve being connected to the fluid discharge passageway of said common inner piston chamber, the valve members of said control valves being oriented to sequentially open and close so as to relieve high pressure fluid in the outer piston chambers prior to the introduction of high pressure fluid into the common inner piston chamber, and to relieve high pressure fluid in the common inner piston chamber prior to the introduction of high pressure fluid into the outer piston chambers, and means for maintaining said passageways and said piston chambers filled with fluid at all times.

7. The hydraulic power system claimed in claim 6 wherein the means for maintaining said passageways and said piston chambers filled with fluid comprises check valves oriented to remain closed until the fluid pressure exceeds a predetermined level which is substantially below that of the high pressure fluid introduced into the system through said delivery passageways.

8. An hydraulic power system comprising a housing, an opposing pair of pistons reciprocally mounted in said housing, a piston chamber at the outer end of each of said pistons, and a common piston chamber at the inner ends of said pistons, said pistons having oppositely directed piston rods projecting outwardly from opposite sides of the housing, one of the piston rods being adapted to be connected to a mass to be moved, and the other of the piston rods being adapted to be connected to a counterbalancing reactive mass, means interconnecting said pistons for movement in unison, first and second control valves each having a high pressure side and a low pressure side, fluid delivery means connecting the high pressure side of the first control valve to the common inner piston chamber, additional fluid delivery means connecting the high pressure side of the second control valve to each of said outer piston chambers, fluid discharge means connecting said common inner piston chamber to the low pressure side of said second control valve, additional fluid discharge means connecting said outer piston chambers to the low pressure side of said first control valve, said control valves each having an axially movable valve stem mounting separate pairs of valve elements connected respectively to the high and low pressure sides of said first control valve and to the high and low pressure sides of said second control valve, means for sequentially moving said valve stems from fully closed to fully opened positions and return, said valve stems including means for sequentially opening and closing the high and low pressure sides of the control valve elements mounted thereon, said control valves each acting, when opened, to introduce fluid under high pressure into each piston chamber to which its high pressure side is connected and to permit fluid under high pressure to be vented from each piston chamber to which its low pressure side is connected, and check valve means associated with the low pressure sides of said control valves for maintaining fluid under reduced pressure in the portions of the system which are vented when said control valves are opened, whereby the system is maintained filled at all times with fluid under positive pressure, and when charges of fluid under high pressure are introduced into the system upon the sequential opening of the control valves, the high pressure charges will react against the fluid maintained in the system and the full force of each high pressure charge will be directed against the pistons so as to displace them to the opposite ends of their strokes.

9. The hydraulic power system claimed in claim 8 wherein one of the valve elements in each pair has bleeder passages therein for venting fluid from one side of the valve element to the other, and wherein the other of the valve elements in each pair acts to open and close said bleeder passages, the last named valve elements being the first to open in each pair as said valve stems are moved from closed to opened positions.

10. The hydraulic power system claimed in claim 9 wherein the valve elements on the low pressure sides of the control valves are set to open prior to the opening of the valve elements on the high pressure sides of the control valves.

11. The hydraulic power system claimed in claim 10 including means normally biasing said valve elements to their closed position.

12. The hydraulic power system claimed in claim 11 wherein said valve elements are slidably mounted on said valve stems, and wherein the means for sequentially opening the valve elements comprise shoulders on said valve stems positioned to sequentially engage the undersurfaces of said valve elements as said valve stems move from their fully closed to their fully opened positions.

13. A method for the vibration-free operation of a fluid power system having a reciprocating work piston adapted to be driven from one end of its stroke to the other by fluid pressure, which comprises the steps of connecting the said work piston to a mass to be moved, providing an opposing piston adapted to be driven from one end of its stroke to the other by fluid pressure, interconnecting said pistons for movement in unison in opposite directions, connecting a reactive mass to said opposing piston, said reactive mass being of the same magnitude as the mass to be moved, establishing an initial position in which said pistons are held in static condition at one end of their respective strokes and each is under positive fluid pressure, one corresponding side of each piston being held under relatively high fluid pressure and the other corresponding side of each piston being maintained under relatively nominal fluid pressure, and driving the pistons to the opposite ends of their strokes by first relieving the high pressure on the first named corresponding sides of the pistons to a nominal level and immediately thereafter rapidly increasing the fluid pressure on the other corresponding sides of said pistons to a high pressure, whereby to drive the pistons to the opposite ends of their strokes, including the step of holding the pistons in static condition at the opposite ends of their strokes by the high pressure fluid until it is desired to drive the pistons to their initial position by first relieving the high pressure fluid to a nominal level and immediately thereafter rapidly increasing the nominal fluid pressure on the said first named corresponding sides of the pistons to a high pressure.

14. The method claimed in claim 13 wherein the high pressure exerted on one side of each piston is relieved to the same nominal fluid pressure exerted on the opposite side of each piston, whereby said pistons are in an equilibrium state prior to increasing the fluid pressure on the said opposite sides of said pistons to drive them from one end of their respective strokes to the other end thereof.

* * * * *